US008720176B2

(12) United States Patent
Pottier et al.

(10) Patent No.: US 8,720,176 B2
(45) Date of Patent: May 13, 2014

(54) METHOD AND DEVICE FOR PRODUCING A THREE-LAYER CORD

(75) Inventors: Thibaud Pottier, Clermont-Ferrand (FR); Jacques Gauthier, Lempdes (FR); Jérémy Toussain, Clermont-Ferrand (FR)

(73) Assignees: Michelin Recherche et Technique S.A., Granges-Paccot (CH); Compagnie Generale des Etablissements Michelin, Clermont-Ferrand (FR)

( * ) Notice: Subject to any disclaimer, the term of this patent is extended or adjusted under 35 U.S.C. 154(b) by 0 days.

(21) Appl. No.: 13/260,977

(22) PCT Filed: Mar. 29, 2010

(86) PCT No.: PCT/EP2010/054063

§ 371 (c)(1),
(2), (4) Date: Jan. 17, 2012

(87) PCT Pub. No.: WO2010/112445

PCT Pub. Date: Oct. 7, 2010

(65) Prior Publication Data

US 2012/0102909 A1 May 3, 2012

(30) Foreign Application Priority Data

Mar. 31, 2009 (FR) ..... 09 52020

(51) Int. Cl.
*D07B 1/00* (2006.01)

(52) U.S. Cl.
USPC ..... 57/213; 57/223

(58) Field of Classification Search
USPC ..... 57/121, 213, 223, 232; 152/451, 527, 152/556
See application file for complete search history.

(56) References Cited

U.S. PATENT DOCUMENTS

| | | | | |
|---|---|---|---|---|
| 2,181,475 | A | 11/1939 | Marcel | |
| 5,592,806 | A * | 1/1997 | Berghmans et al. | 57/212 |
| 7,228,681 | B2 * | 6/2007 | Meersschaut et al. | 57/213 |
| 2003/0167581 | A1 * | 9/2003 | Yamazaki et al. | 8/536 |

FOREIGN PATENT DOCUMENTS

| | | |
|---|---|---|
| EP | 0 635 597 | 1/1995 |

(Continued)

*Primary Examiner* — Shaun R Hurley
(74) *Attorney, Agent, or Firm* — Cozen O'Connor

(57) ABSTRACT

Method of manufacturing a metal cord with three concentric layers (C1, C2, C3), of the type rubberized in situ, i.e. incorporating a composition made of rubber in the uncrosslinked state referred to as "filling rubber", the said cable comprising a first, internal, layer or core (C1), around which there are wound together in a helix, at a pitch $p_2$, in a second, intermediate, layer (C2), N wires of diameter $d_2$, N varying from 3 to 12, around which second layer there are wound together as a helix at a pitch $p_3$, in a third, outer, layer (C3), P wires of diameter $d_3$, P varying from 8 to 20, the said method comprising the following steps: a first sheathing step in which the core (C1) is sheathed with the filling rubber; a first assembling step by twisting the N wires of the second layer (C2) around the core (C1) thus sheathed in order to form, at a point named the "assembling point", an intermediate cord named "core strand" (C1+C2); downstream of the said assembling point, a second sheathing step in which the core strand (C1+C2) is sheathed with the filling rubber; a second assembling step in which the P wires of the third layer (C3) are twisted around the core strand (C1+C2) thus sheathed; a final twist-balancing step.

19 Claims, 2 Drawing Sheets

(56) References Cited

FOREIGN PATENT DOCUMENTS

| | | |
|---|---|---|
| EP | 0 744 490 | 7/2003 |
| FR | 2 925 922 | 7/2009 |
| FR | 2 925 923 | 7/2009 |
| JP | 2004-277923 | 10/2004 |
| JP | 2007-303044 | 11/2007 |
| WO | WO 2005/014924 | 2/2005 |
| WO | WO 2005/071157 | 8/2005 |
| WO | WO 2009/041677 | 4/2009 |

* cited by examiner

METHOD AND DEVICE FOR PRODUCING A THREE-LAYER CORD

RELATED APPLICATIONS

This is a U.S. National Stage of International Application No. PCT/EP2010/054063 filed on 29 Mar. 2010.

This application claims the priority of French patent application Ser. No. 09/52020 filed 31 Mar. 2009 the disclosure of which is hereby incorporated by reference.

FIELD OF THE INVENTION

The present invention relates to the methods and devices for manufacturing three-layer metallic cords notably of M+N+P construction that can be used in particular for reinforcing articles made of rubber, such as tires.

It relates more particularly to the methods and devices for manufacturing metallic cords of the type "rubberized in situ", i.e. cords that are rubberized from the inside, during their actual manufacture, with rubber in the uncrosslinked state in order notably to improve their corrosion resistance and therefore their endurance notably in carcass reinforcements of tires for industrial vehicles.

BACKGROUND OF THE INVENTION

As is known, a radial tyre comprises a tread, two inextensible beads, two sidewalls connecting the beads to the tread and a belt positioned circumferentially between the carcass reinforcement and the tread. This carcass reinforcement is made up in the known way of at least one ply (or "layer") of rubber which is reinforced with reinforcing elements ("reinforcers") such as cords or monofilaments, generally of the metallic type in the case of tires for industrial vehicles which carry heavy loads.

To reinforce the above carcass reinforcements, use is generally made of what are known as "layered" steel cords made up of a central layer or core and one or more concentric layers of wires positioned around this core. The three-layered cords most often used are essentially cords of M+N+P construction formed of a core of M wire(s), M varying from 1 to 4, surrounded by an intermediate layer of N wires, N typically varying from 3 to 12, itself surrounded by an outer layer of P wires, P typically varying from 8 to 20, it being possible for the entire assembly to be wrapped with an external wrapper wound in a helix around the outer layer.

As is well known, these layered cords are subjected to high stresses when the tires are running along, notably to repeated bendings or variations in curvature which cause rubbing on the wires, notably as a result of contact between adjacent layers, and therefore to wear, as well as fatigue; they therefore have to have high resistance to what is known as "fretting fatigue".

It is also particularly important for them to be impregnated as far as possible with the rubber, for this material to penetrate into all the spaces between the wires that make up the cords. Indeed, if this penetration is insufficient, empty channels or capillaries are then formed along and within the cords, and corrosive agents, such as water or even the oxygen in the air, liable to penetrate the tires, for example as a result of cuts in their treads, travel along these empty channels into the carcass of the tyre. The presence of this moisture plays an important role in causing corrosion and accelerating the above degradation processes (the so-called "corrosion fatigue" phenomena), as compared with use in a dry atmosphere.

All these fatigue phenomena that are generally grouped under the generic term "fretting corrosion fatigue" cause progressive degeneration of the mechanical properties of the cords and may, under the severest running conditions, affect the life of these cords.

To alleviate the above disadvantages, application WO 2005/071157 has proposed three-layered cords of 1+M+N construction, particularly of 1+6+12 construction, one of the essential features of which is that a sheath consisting of a rubber composition covers at least the intermediate layer made up of the M wires, it being possible for the core (or individual wire) of the cord itself either to be covered or not to be covered with rubber. Thanks to this special design, not only is excellent rubber penetrability obtained, limiting problems of corrosion, but the fretting fatigue endurance properties are also notably improved over the cords of the prior art. The longevity of the tires and that of their carcass reinforcements are thus very appreciably improved.

However, the described methods for the manufacture of these cords, and the resulting cords themselves, are not free of disadvantages.

First of all, these three-layer cords are obtained in several steps which have the disadvantage of being discontinuous, firstly involving creating an intermediate 1+M (particularly 1+6) cord, then sheathing this intermediate cord using an extrusion head, and finally a final operation of cabling the remaining N (particularly 12) wires around the core thus sheathed, in order to form the outer layer. In order to avoid the problem of the very high tack of uncured rubber of the rubber sheath before the outer layer is cabled around the core, use must also be made of a plastic interlayer film during the intermediate spooling and unspooling operations. All these successive handling operations are punitive from the industrial standpoint and go counter to achieving high manufacturing rates.

Further, if there is a desire to ensure a high level of penetration of the rubber into the cord in order to obtain the lowest possible air permeability of the cord along its axis, it has been found that it is necessary using these methods of the prior art to use relatively high quantities of rubber during the sheathing operation. Such quantities lead to more or less pronounced unwanted overspill of uncured rubber at the periphery of the as-manufactured finished cord.

Now, as has already been mentioned hereinabove, because of the very high tack that rubber in the uncured (uncrosslinked) state has, such unwanted overspill in turn gives rise to appreciable disadvantages during later handling of the cord, particularly during the calendering operations which will follow for incorporating the cord into a strip of rubber, likewise in the uncured state, prior to the final operations of manufacturing the tyre tread and final curing.

All of the above disadvantages of course slow down the industrial production rates and have an adverse effect on the final cost of the cords and of the tires they reinforce.

SUMMARY OF THE INVENTION

One object of the present invention is to provide an improved method of manufacture which is able to alleviate the aforementioned disadvantages.

Consequently, one aspect of the invention is directed to a method of manufacturing a metal cord with three concentric layers (C1, C2, C3) of the type rubberized in situ, i.e. incorporating a composition made of rubber in the uncrosslinked (uncured) state referred to as "filling rubber", the said cord comprising a first, internal, layer or core (C1), around which there are wound together in a helix, at a pitch $p_2$, in a second, intermediate, layer (C2), N wires of diameter $d_2$, N varying from 3 to 12, around which second layer there are wound together as a helix at a pitch $p_3$, in a third, outer, layer (C3), P wires of diameter $d_3$, P varying from 8 to 20, the said method comprising the following steps:

- a first sheathing step in which the core (C1) is sheathed with the filling rubber;
- a first assembling step by twisting the N wires of the second layer (C2) around the core (C1) thus sheathed in order to form, at a point named the "assembling point", an intermediate cord named "core strand" (C1+C2);
- downstream of the said assembling point, a second sheathing step in which the core strand (C1+C2) is sheathed with the filling rubber;
- a second assembling step in which the P wires of the third layer (C3) are twisted around the core strand (C1+C2) thus sheathed;

a final twist-balancing step.

This method of the invention makes it possible, preferably continuously and in line, to manufacture a three-layer cord which, by comparison with the in-situ-rubberized three-layer cords of the prior art, has the notable advantage of containing a smaller quantity of filling rubber, making it more compact, this rubber also being uniformly distributed within the cord, in each of its capillaries, thus giving it even better longitudinal impermeability.

Another aspect of the invention relates to an in-line rubberizing and assembling device that can be used for implementing a method of the invention, the said device comprising, from upstream to downstream in the direction of travel of the cord as it is being formed:

- feed means for feeding the first layer or core (C1);
- first sheathing means for sheathing the core (C1);
- feed means for feeding the N wires of the second layer (C2) and first assembling means which by twisting assemble these N wires around the sheathed core (C1), at a point named the "assembling point", to form an intermediate cord named "core strand" (C1+C2);
- downstream of the said assembling point, second sheathing means of sheathing the core strand (C1+C2);
- at the exit from the second sheathing means, feed means for feeding the P wires of the third layer (C3) and second assembling means which by twisting assemble these P wires around the core strand (C1+C2), in order to apply the third layer (C3);

at the exit from the said second assembling means, twist balancing means.

BRIEF DESCRIPTION OF THE DRAWINGS

The invention and its advantages will be readily understood in light of the description and of the exemplary embodiments which follow, and from FIGS. 1 to 3 which relate to these embodiments.

I. Detailed Description of the Drawings

Figure 1:
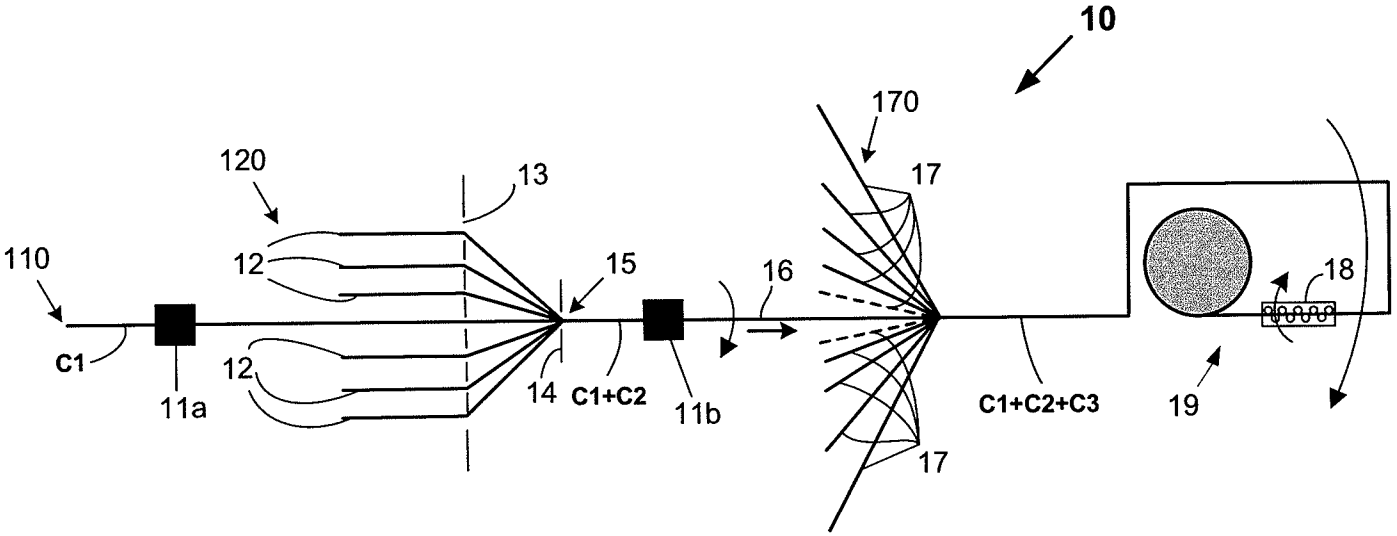
FIG. 1 shows one example of an in-situ rubberizing and twisting device that can be used for the manufacture of a three-layer cord of compact type, according to an embodiment of a method in accordance with the invention.

In the present description, unless expressly indicated otherwise, all the percentages (%) indicated are percentages by weight.

Moreover, any range of values denoted by the expression "between a and b" represents the range of values extending from more than a to less than b (i.e. excluding the end points a and b), whereas any range of values denoted by the expression "from a to b" means the range of values extending from a to b (i.e. including the strict end points a and b).

The method of the invention is intended for the manufacture of a metal cord with three concentric layers (C1, C2, C3), of the type rubberized in situ, i.e. incorporating a composition made of rubber in the uncured or uncrosslinked state known as "filling rubber", the said cord comprising a first, internal, layer or core (C1), around which there are wound together in a helix, at a pitch $p_2$, in a second, intermediate, layer (C2), N wires of diameter $d_2$, N varying from 3 to 12, around which second layer there are wound together as a helix at a pitch $p_3$, in a third, outer, layer (C3), P wires of diameter $d_3$, P varying from 8 to 20, the said method comprising the following steps which are preferably performed in line and continuously:

- a first sheathing step in which the core (C1) is sheathed with the filling rubber in the uncured (i.e. uncrosslinked or uncooked) state;
- a first assembling step by twisting the N wires of the second layer (C2) around the core (C1) thus sheathed in order to form, at a point named the "assembling point", an intermediate cord named "core strand" (C1+C2);
- downstream of the assembling point, a second sheathing step in which the core strand (C1+C2) is sheathed with the filling rubber;
- a second assembling step in which the P wires of the third layer (C3) are twisted around the core strand thus sheathed;
- a final twist-balancing step.

It will be recalled here that there are two possible techniques for assembling metal wires:

- either by cabling: in which case the wires undergo no twisting about their own axis, because of a synchronous rotation before and after the assembling point;
- or by twisting: in which case the wires undergo both a collective twist and an individual twist about their own axis, thereby generating an untwisting torque on each of the wires.

One essential feature of the above method is the use of a twisting step both for assembling the second layer (C2) around the first layer (C1) and for assembling the third layer (C3) around the second layer (C2).

The diameter $d_0$ (or overall size diameter) of the core (C1) is preferably comprised in a range from 0.08 to 0.50 mm, it being possible for this core to be made up of a single wire or even of several wires already assembled with one another by any known means, for example by cabling or more preferably by twisting. For preference, the number denoted "M" of wire(s) in the core is comprised in a range from 1 to 4. More preferably, the core is made up of a single individual wire (M equal to 1) of which the diameter $d_1$ is itself more preferentially comprised in a range from 0.08 to 0.50 mm.

During the first sheathing step, this core is first of all sheathed with filling rubber in the uncrosslinked state, supplied by an extrusion screw at an appropriate temperature. The filling rubber can thus be delivered at a single and small-volume fixed point by means of a single extrusion head.

The extrusion head may comprise one or more dies, for example an upstream guiding die and a downstream sizing die. Means for continuously measuring and controlling the diameter of the sheathed core may be added, these being connected to the extruder, as well as means for controlling the centring of the core within the extrusion head. For preference, the temperature at which the filling rubber is extruded is comprised between 50° C. and 120° C., and more preferably is comprised between 50° C. and 100° C.

The extrusion head thus defines a sheathing zone having the shape of a cylinder of revolution, the diameter of which is preferably comprised between 0.15 mm and 1.2 mm, more preferably between 0.2 and 1.0 mm, and the length of which is preferably comprised between 4 and 10 mm.

Typically, on leaving the extrusion head, the core of the cord, at all points on its periphery, is covered with a minimum thickness of filling rubber which thickness preferably exceeds 5 μm, more preferably still exceeds 10 μm, in particular exceeds 15 μm, and is notably comprised between 15 and 40 μm.

The elastomer (or indiscriminately "rubber", the two being considered as synonymous) of the filling rubber is preferably a diene elastomer, i.e. by definition an elastomer originating at least in part (i.e. a homopolymer or copolymer) from diene monomer(s) (i.e. monomer(s) bearing two, conjugated or otherwise, carbon-carbon double bonds). The diene elastomer is more preferably chosen from the group consisting of polybutadienes (BR), natural rubber (NR), synthetic polyisoprenes (IR), various copolymers of butadiene, various copolymers of isoprene, and blends of these elastomers. Such copolymers are more preferably chosen from the group consisting of butadiene-styrene copolymers (SBR), whether these are prepared by emulsion polymerization (ESBR) or solution polymerization (SSBR), butadiene-isoprene copolymers (BIR), styrene-isoprene copolymers (SIR) and styrene-butadiene-isoprene copolymers (SBIR).

One preferred embodiment is to use an "isoprene" elastomer, i.e. a homopolymer or copolymer of isoprene, in other words a diene elastomer chosen from the group consisting of natural rubber (NR), synthetic polyisoprenes (IR), various isoprene copolymers and blends of these elastomers. The isoprene elastomer is preferably natural rubber or a synthetic polyisoprene of the cis-1,4 type. Of these synthetic polyisoprenes, use is preferably made of polyisoprenes having a content (in mol %) of cis-1,4 bonds greater than 90%, more preferably still greater than 98%. According to other preferred embodiments, the isoprene elastomer may also be combined with another diene elastomer, such as one of the SBR and/or BR type, for example.

The filling rubber may contain just one elastomer or several elastomers, notably of the diene type, it being possible for this or these to be used in combination with any type of polymer other than an elastomer.

The filling rubber is preferably of the crosslinkable type, i.e. it by definition contains a crosslinking system suitable for allowing the composition to crosslink during its curing process (i.e. so that, when it is heated, it hardens rather than melts); thus, in such an instance, this rubber composition may be qualified as unmeltable, because it cannot be melted by heating, whatever the temperature. For preference, in the case of a diene rubber composition, the crosslinking system for the rubber sheath is a system known as a vulcanizing system, i.e. one based on sulphur (or on a sulphur donor agent) and at least one vulcanization accelerator. However, the invention also applies to instances in which the filler rubber does not contain sulphur or even any other crosslinking system, it being understood that the crosslinking or vulcanizing system already present in the rubber matrix that the cord of the invention is intended to reinforce might be sufficient for its crosslinking or vulcanizing and able to migrate through contact from said surrounding matrix into the filling rubber.

The filling rubber may also contain all or some of the customary additives intended for the rubber matrixes used in tires, such as reinforcing fillers such as carbon black or silica, antioxidants, oils, plasticisers, anti-reversion agents, resins, adhesion promoters such as cobalt salts.

The content of reinforcing filler, for example carbon black or an inorganic reinforcing filler such as silica, is preferably greater than 50 phr, for example comprised between 50 and 120 phr. As carbon blacks, for example, all carbon blacks, particularly of the HAF, ISAF, SAF type conventionally used in tires (known as tyre-grade blacks), are suitable. Of these, mention may more particularly be made of carbon blacks of (ASTM) 300, 600 or 700 grade (for example N326, N330, N347, N375, N683, N772). Suitable inorganic reinforcing fillers notably include inorganic fillers of the silica ($SiO_2$) type, especially precipitated or pyrogenic silicas having a BET surface area of less than 450 $m^2/g$, preferably from 30 to 400 $m^2/g$.

At the end of the preceding first sheathing step, during the first assembling step, the N wires of the second layer (C2) are twisted together (S or Z direction) around the sheathed core (C1) to form, at a point known as the assembling point, the core strand (C1+C2) in a way known per se; the wires are delivered by feed means such as spools, a separating grid, which may or may not be coupled to an assembling guide, intended to make the N wires converge around the core on a common twisting point (or assembling point).

For preference, the diameter $d_2$ of the N wires is comprised in a range from 0.08 to 0.45 mm and the twisting pitch $p_2$ is comprised in a range from 5 to 30 mm. It will be recalled here that, in the known way, the pitch "p" represents the length, measured parallel to the axis of the cord, after which a wire that has this pitch has made a complete turn around the said axis of the cord.

During this twisting, the N wires come to bear against the filling rubber, becoming encrusted in the sheath of rubber covering the core (C1). This filling rubber, in sufficient quantity, then naturally fills the capillary gaps formed between the core (C1) and the second layer (C2).

Downstream of the assembling point, the tensile stress applied on the core strand is preferably comprised between 10 and 25% of its breaking strength.

During a second sheathing step, the core strand (C1+C2) thus formed is in turn sheathed with the filling rubber in the uncured state, provided for example in a second extrusion head raised to a suitable temperature.

As before, this extrusion head may comprise one or more dies, for example an upstream guiding die and a downstream sizing die. Means for continuously measuring and controlling the diameter of the sheathed core strand may also be added, these being connected to the extruder, as may means for controlling the centring of the core strand within the extrusion head. For preference, the temperature at which the filling rubber is extruded is comprised between 50° C. and 120° C., and more preferably is comprised between 50° C. and 100° C.

The extrusion head defines a sheathing zone having the shape of a cylinder of revolution, the diameter of which is preferably comprised between 0.4 and 1.2 mm, more preferably between 0.5 and 1.0 mm, and the length of which is preferably comprised between 4 and 10 mm.

Typically, on leaving the second extrusion head, the core strand (C1+C2) thus sheathed, at all points on its periphery, is covered with a minimum thickness of filling rubber which thickness preferably exceeds 5 μm, more preferably still exceeds 10 μm, and is notably comprised between 15 and 50 μm.

During a second assembling step, the P wires of the third layer or outer layer (C3) are finally assembled, again by twisting (S or Z direction) around the core strand (C1+C2) thus sheathed. For preference, the diameter $d_3$ of the P wires is comprised in a range from 0.08 to 0.45 mm and the twisting pitch $p_3$ is greater than or equal to $p_2$, particularly comprised in a range from 5 to 30 mm.

During the twisting, the P wires in turn come to bear against the filling rubber present at the periphery of the core strand, becoming encrusted therein. The filling rubber, under the pressure applied by these P external wires, then partially fills the capillaries or cavities left empty by the wires, between the second layer (C2) and the outer layer (C3).

At this stage in the process, the cord of the invention is not finished: the above capillaries, which are delimited by the N wires of the second layer (C2) and the P wires of the third layer (C3), are not yet full enough of filling rubber to yield a cord of optimal air impermeability.

The essential step which follows involves passing the cord thus provided with its filling rubber in the uncured state, through twist balancing means. What is meant here by "twist balancing" is, in the known way, the cancelling out of residual twisting torques (or untwisting springback) exerted on each wire of the cord in the twisted state, within its respective layer. Twist balancing tools are known to those skilled in the art of twisting; they may for example consist of straighteners and/or of "twisters" and/or of "twister-straighteners" consisting either of pulleys in the case of twisters, or of small-diameter rollers in the case of straighteners, through which pulleys or rollers the cord runs, in one single plane or preferably in at least two different planes.

It is assumed a posteriori that, during the passage through the various balancing means above, said balancing means generate, on the N and P wires of the second and third layers (C2 and C3) a twist and radial pressure which are sufficient to spread and uniformly distribute the filling rubber in the uncured (i.e. uncrosslinked, uncooked) state, which is still hot and relatively fluid, into the capillaries formed by the N wires of the second layer (C2) and the P wires of the third layer (C3), ultimately giving the cord of the invention the excellent air impermeability property that characterizes it. The straightening function afforded by the use of a straightening tool would also have the advantage that contact between the rollers of the straightener and the wires of the outer layer (C3) will apply additional pressure to the filling rubber, further encouraging it to fully penetrate the capillaries present between the second layer (C2) and the third layer (C3) of the cord.

In other words, the process of the invention described hereinabove uses the twist of the wires and the radial pressure exerted on the said wires, in the final stage of manufacture of the cord to distribute the filling rubber radially inside the cord, while at the same time perfectly controlling the amount of filling rubber supplied. The person skilled in the art will particularly know how to adjust the arrangement, the diameter of the pulleys and/or rollers of the twist-balancing means with a view to varying the intensity of the radial pressure exerted on the wires.

Thus, unexpectedly, it has proved possible to make the filling rubber penetrate into the very heart of the cord of the invention, into all of its capillaries, by depositing the rubber downstream of the point of assembly of the N wires around the first layer of the core (C1), while at the same time still controlling and optimizing the amount of filling rubber delivered, thanks to the use of two successive extrusion heads.

After this final twist balancing step, the manufacture of the cord according to the method of the invention, rubberized in situ with its filling rubber in the uncured state, is complete. For preference, in this completed cord, the thickness of filling rubber between two adjacent wires of the cord, whichever these wires might be, is greater than 1 μm, preferably comprised between 1 and 10 μm. This cord can be wound onto a receiving spool, for storage, before for example being treated via a calendering installation, in order to prepare a metal/rubber composite fabric that can be used for example as a tyre carcass reinforcement.

According to one preferred embodiment of the invention, the total quantity of filling rubber delivered by the first and second sheathing means described hereinabove is adjusted in a preferred range comprised between 5 and 40 mg, notably between 5 and 30 mg per gram of final (i.e. manufacturing complete, rubberized in situ) cord. Thus, according to one particular embodiment of the invention, the quantity of filling rubber delivered by each of the first and second sheathing means may advantageously be adjusted in a preferred range comprised between 2.5 and 20 mg, notably between 2.5 and 15 mg per gram of final cord.

Below the indicated minima, it is not possible to guarantee that the filling rubber will indeed be present in each of the capillaries or gaps of the cord, whereas above the recommended maxima, the cord may be exposed to the various aforementioned problems due to overspilling of filling rubber at the periphery of the cord, depending on the particular conditions of operation of the invention and the specific construction of cords manufactured.

According to another preferred embodiment of the invention, it is the following relationship which is satisfied ($d_1$, $d_2$, $d_3$, $p_2$ and $p_3$ being expressed in mm):

$$5\pi(d_1+d_2)<p_2\leq p_3<10\pi(d_1+2d_2+d_3).$$

More specifically, it is the following relationship that is satisfied:

$$5\pi(d_1+d_2)<p_2\leq p_3<5\pi(d_1+2d_2+d_3).$$

Advantageously, the pitches $p_2$ and $p_3$ are equal, making the manufacturing process simpler.

The person skilled in the art will know, in the light of the present description, how to adjust the formulation of the filling rubber in order to achieve the levels of properties (particularly elastic modulus) desired, and how to adapt the formulation to suit the intended specific application.

In a first embodiment of the invention, the formulation of the filling rubber can be chosen to be identical to the formulation of the rubber matrix that the final cord is intended to reinforce; there will therefore be no problem of compatibility between the respective materials of the filling rubber and of the said rubber matrix.

According to a second embodiment of the invention, the formulation of the filling rubber may be chosen to differ from the formulation of the rubber matrix that the final cord is intended to reinforce. Notably, the formulation of the filling rubber can be adjusted by using a relatively high quantity of adhesion promoter, typically for example from 5 to 15 phr of a metallic salt such as a cobalt, nickel salt or a lanthanide salt such as a neodymium salt (see in particular application WO 2005/113666), and advantageously reducing the quantity of the said promoter (or even omitting it altogether) in the surrounding rubber matrix. Of course, it might also be possible to adjust the formulation of the filling rubber in order to optimize its viscosity and thus its ability to penetrate the cord when the latter is being manufactured.

For preference, the filling rubber, in the crosslinked state, has a secant modulus in extension E10 (at 10% elongation) which is comprised between 2 and 25 MPa, more preferably between 3 and 20 MPa, and in particular comprised in a range from 3 to 15 MPa.

For preference, the third layer (C3) has the preferred feature of being a saturated layer, i.e. by definition, there is not enough space in this layer for at least one ($P_{max}$+1)th wire of diameter $d_3$ to be added, $P_{max}$ representing the maximum number of wires that can be wound in a third layer (C3) around the second layer (C2). This construction has the advantage of limiting the risk of overspill of filling rubber at its periphery and, for a given cord diameter, of offering greater strength.

Thus, the number P of wires in the third layer can vary to a very large extent according to the particular embodiment of the invention, it being understood that the maximum number of wires P will be increased if their diameter $d_3$ is reduced by comparison with the diameter $d_2$ of the wires of the second layer, in order preferably to keep the outer layer in a saturated state.

For preference, the first layer (C1) consists of an individual wire (i.e., M=1) and the diameter $d_1$ is comprised in a range from 0.08 to 0.50 mm.

If the core (C1) consists of a plurality of wires (i.e., M is other an I), then the M wires are preferably assembled together at an assembly pitch which is preferably comprised between 4 and 15 mm, notably between 5 and 10 mm.

According to another preferred embodiment, the second layer (C2) contains 5 to 7 wires (i.e., N varies from 5 to 7). According to another particularly preferred embodiment, the layer C3 contains from 10 to 14 wires; of the abovementioned cords those more particularly selected are those consisting of wires that have substantially the same diameter from layer C2 to layer C3 (namely $d_2=d_3$).

According to another, more preferable, embodiment, the first layer (C1) comprises a single wire (M equal to 1), the second layer (C2) comprises 6 wires (N equal to 6) and the third layer (C3) comprises 11 or 12 wires (P equal to 11 or 12). In other words, the cord of the invention has the preferential construction 1+6+11 or 1+6+12.

The cord prepared in accordance with the invention, like any layered cord, may be of two types, namely of the compact layers type or of the cylindrical layers type.

Figure 2:
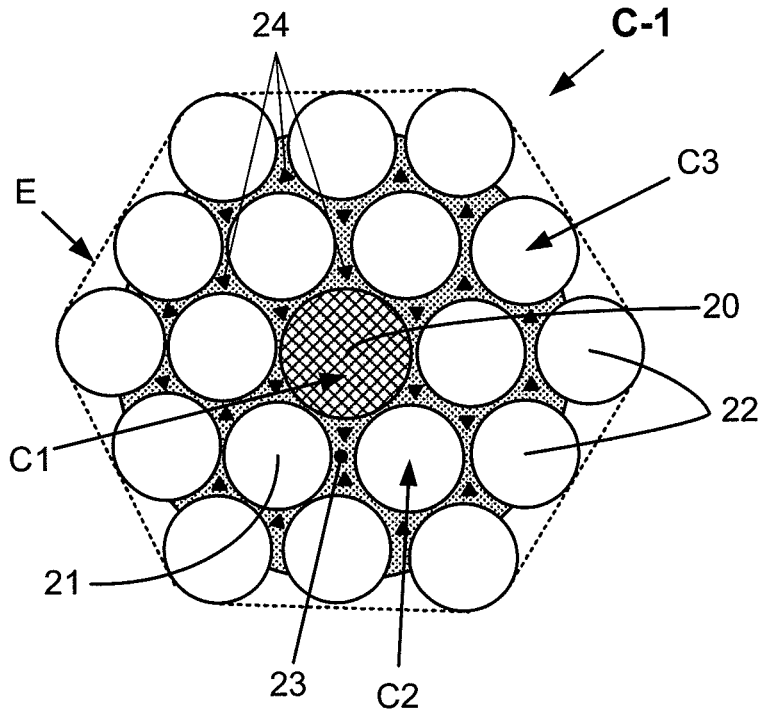
FIG. 2 shows, in cross section, a cord of 1+6+12 construction, rubberized in situ, of the compact type, and which can be manufactured using an embodiment of a method of the invention.

In a particularly preferred embodiment of the invention, the wires of the third layer (C3) are wound in a helix at the same pitch ($p_2=p_3$) and in the same direction of twisting (i.e. either in the S direction ("S/S" layout) or in the Z direction ("Z/Z" layout)) as the wires of the second, intermediate, layer (C2), in order to obtain a layered cord of compact type as schematically indicated for example in FIG. 2.

Figure 3:
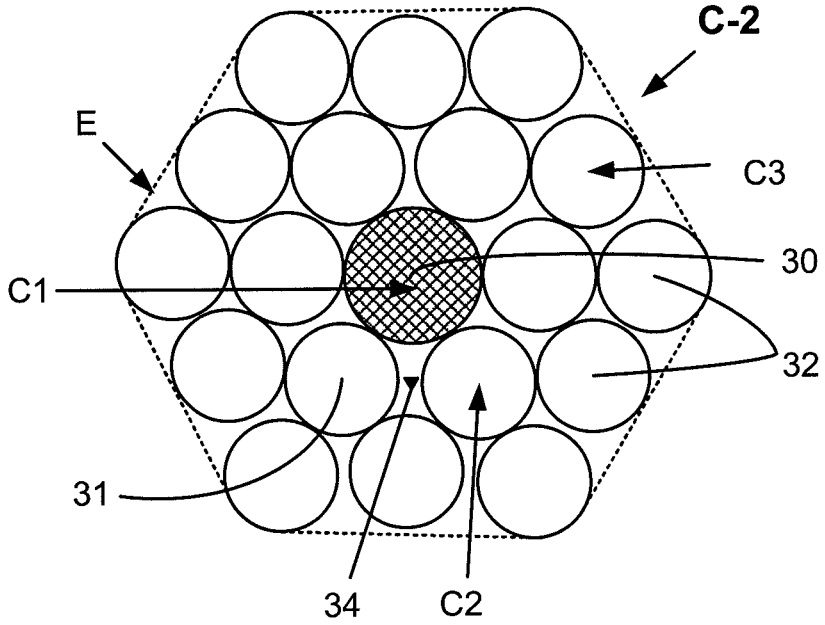
FIG. 3 shows, in cross section, a conventional cord of 1+6+12 construction, not rubberized in situ, but likewise of the compact type.

In such compact layer cords, the compactness is such that practically no distinct layer of wires is visible; this means that the cross section of such cords has a contour which is generally polygonal rather than cylindrical, as illustrated for example in FIG. 2 (1+6+12 compact cord rubberized in situ) and FIG. 3 (conventional 1+6+12 compact cord, that is to say one that has not been rubberized in situ).

Thus prepared, the cord produced in accordance with the invention may be termed airtight in the cured state: in the air permeability test described in paragraph II-1-B hereafter, it is characterized by an average air flow rate of less than 2 $cm^3$/min, preferably of 0.2 $cm^3$/min or less.

The method of the invention has the advantage of making it possible to perform the complete operation of initial twisting, rubberizing and final twisting in line and in a single step, regardless of the type of cord produced (compact cord or cylindrical layered cord), and to do all of this at high speed. The above method can be implemented at a speed (speed of travel of the cord along the twisting-rubberizing line) in excess of 50 m/min, preferably in excess of 70 m/min.

The method of the invention makes it possible to manufacture cords which may have no (or virtually no) filling rubber at their periphery. What is meant by that is that no particle of filling rubber is visible, to the naked eye, on the periphery of the cord, that is to say that a person skilled in the art would, after manufacture, see no difference, to the naked eye, from a distance of three meters or more, between a spool of cord in accordance with the invention and a spool of conventional cord that has not been rubberized in situ.

This method of course applies to the manufacture of cords of compact type (as a reminder and by definition, those in which the layers C2 and C3 are wound at the same pitch and in the same direction) and to the manufacture of cords of the cylindrical layers type (as a reminder and by definition, those in which the layers C2 and C3 are wound either at different pitches (whatever their direction of twisting, identical or otherwise) or in opposite directions (whatever their pitches, identical or different)).

The term "metal cord" is understood by definition in the present application to mean a cord formed from wires consisting predominantly (i.e. more than 50% by number of these wires) or entirely (100% of the wires) of metallic material. Independently of one another, and from one layer to another, the wire or wires of the core (C1), the wires of the second layer (C2) and the wires of the third layer (C3) are preferably made of steel, more preferably of carbon steel. However, it is of course possible to use other steels, for example a stainless steel, or other alloys. When a carbon steel is used, its carbon content (% by weight of steel) is preferably comprised between 0.4% and 1.2%, notably between 0.5% and 1.1%; these contents represent a good compromise between the mechanical properties required for the tyre and the feasibility of the wires. It should be noted that a carbon content comprised between 0.5% and 0.6% ultimately makes such steels less expensive because they are easier to draw. Another advantageous embodiment of the invention may also consist, depending on the intended applications, in using steels with a low carbon content, comprised for example between 0.2% and 0.5%, particularly because of a lower cost and greater drawability.

An assembling and rubberizing device that can preferably be used for implementing the method of the invention as described previously, is a device comprising, from upstream to downstream in the direction of travel of a cord as it is being formed:

- feed means for feeding the first layer or core (C1);
- first sheathing means for sheathing the core (C1);
- feed means for feeding the N wires of the second layer (C2) and first assembling means which by twisting assemble these N wires around the sheathed core (C1) at a point named the assembling point, to form an intermediate cord named "core strand" (C1+C2);
- downstream of the said assembling point, second sheathing means of sheathing the core strand (C1+C2);
- at the exit from the second sheathing means, feed means for feeding the P wires of the third layer (C3) and second assembling means which by twisting assemble these P wires around the core strand (C1+C2), in order to apply the third layer (C3);
- at the exit from the said second assembling means, twist balancing means.

The attached FIG. 1 shows an example of a twisting assembling device (10), of the type having a stationary feed and a rotating receiver, that can be used for the manufacture of a cord of the compact type ($p_2=p_3$ and same direction of twisting of the layers C2 and C3) as illustrated, for example, in FIG. 2 discussed below.

In this device (10), a single core wire (C1) delivered by feed means (110) passes first of all through a sheathing zone consisting, for example, of a first extrusion head (11*a*). Feed means (120) then deliver, around the core wire (C1) thus sheathed, N wires (12) through a distributing grid (13) (an axisymmetric distributor), which may or may not be coupled to an assembling guide (14), beyond which grid the N (for example six) wires of the second layer converge on an assembling point (15) in order to form the core strand (C1+C2) of 1+N (for example 1+6) construction. The distance between the first sheathing point (11*a*) the point of convergence (15) and is, for example, comprised between 1 and 5 meters.

The core strand (C1+C2), thus formed, is then sheathed in its turn by passing through a second sheathing zone (11*b*) consisting, for example, of a second extrusion head. The distance between the assembling point (15) and the second sheathing point (11*b*) is for example comprised between 50 cm and 5 meters.

The P wires (17) of the outer layer (C3), of which there are for example twelve, delivered by feed means (170) are then assembled by twisting around the core strand (16) thus sheathed, progressing in the direction of the arrow. The final cord (C1+C2+C3) is finally collected on the rotary receiver (19) after having passed through the twist balancing means (18) which, for example, consist of a straightener or of a twister-straightener.

It will be recalled here that, as is well known to those skilled in the art, in order to manufacture a cord of the cylindrical layers type (pitches $p_2$ and $p_3$ different and/or different directions of twisting for layers C2 and C3), use is made of a device comprising two rotating (feed or receiver) members rather than just the one as described above (FIG. 1) by way of example.

FIG. 2 schematically depicts, in cross section perpendicular to the axis of the cord (which is assumed to be straight and at rest), one example of a preferred 1+6+12 cord rubberized in situ and which can be obtained using the previously-described method according to the invention. This cord (denoted C-1) is of the compact type, that is to say that its second and third layers (C2 and C3 respectively) are wound in the same direction (S/S or Z/Z to use the recognized terminology) and in addition have the same pitch ($p_2=p_3$). This type of construction has the effect that the wires (21, 22) of these second and third layers (C2, C3) form, around the core (20) or first layer (C1), two substantially concentric layers which each have a contour (E) (depicted in dotted line) which is substantially polygonal (more specifically hexagonal) rather than cylindrical as in the case of cords of the so-called cylindrical layer type.

This cord C-1 may be qualified as a cord rubberized in situ: each of the capillaries or gaps (empty spaces when no filling rubber is present) formed by the adjacent wires, considered in threes, of its three layers C1, C2 and C3, is filled, at least in part (continuously or otherwise along the axis of the cord) with the filling rubber so that for any 2 cm length of cord, each capillary contains at least one plug of rubber.

More specifically, the filling rubber (23) fills each capillary (24) (symbolized by a triangle) formed by the adjacent wires (considered in threes) of the various layers (C1, C2, C3) of the cord, very slightly moving these apart. It may be seen that these capillaries or gaps are naturally formed either by the core wire (20) and the wires (21) of the second layer (C2) surrounding it, or by two wires (21) of the second layer (C2) and one wire (23) of the third layer (C3) which is immediately adjacent to them, or alternatively still by each wire (21) of the second layer (C2) and the two wires (22) of the third layer (C3) which are immediately adjacent to it; thus in total there are 24 capillaries or gaps (24) present in this 1+6+12 cord.

According to a preferred embodiment, in this preferred 1+N+P cord, the filling rubber preferably extends continuously around the second layer (C2) which it covers.

For comparison, FIG. 3 provides a reminder, in cross section, of a conventional 1+6+12 cord (denoted C-2), namely one that has not been rubberized in situ, likewise of the compact type. The absence of filling rubber means that practically all of the wires (30, 31, 32) are in contact with one another, leading to a structure that is particularly compact, but on the other hand very difficult (if not to say impossible) for rubber to penetrate from the outside. The characteristic of this type of cord is that the various wires in threes form channels or capillaries (34) which, in the case of a great many of them, remain closed and empty and are therefore propicious, through the "wicking" effect, to the propagation of corrosive media such as water.

By way of preferred examples, the method of the invention is used for the manufacture of cords of 1+6+11 and 1+6+12 construction, notably, of the latter, cords consisting of wires that have substantially the same diameter from the second layer (C2) to the third layer (C3) (i.e. in this case, $d_2=d_3$).

II. Embodiments of the Invention

The following tests demonstrate the ability of the method of the invention to provide three-layer cords which, by comparison with the in-situ-rubberized three-layer cords of the prior art, have the appreciable advantage of containing a smaller quantity of filling rubber, guaranteeing them better compactness, this rubber also being distributed uniformly within the cord, inside each of its capillaries, thus giving them optimum longitudinal impermeability.

II-1. Measurements and Tests Used

II-1-A. Dynamometric Measurements

As regards the metal wires and cords, measurements of the breaking strength denoted Fm (maximum load in N), tensile strength denoted Rm (in MPa) and elongation at break, denoted At (total elongation in %) are carried out in tension in accordance with standard ISO 6892 of 1984.

As regards the rubber compositions, the modulus measurements are carried out under tension, unless otherwise indicated, in accordance with standard ASTM D 412 of 1998 (specimen "C"): the "true" secant modulus (i.e. the modulus with respect to the actual cross section of the specimen) at 10% elongation, denoted E10 and expressed in MPa, is measured on second elongation (that is to say, after one accommodation cycle) (normal temperature and moisture conditions in accordance with standard ASTM D 1349 of 1999).

II-1-B. Air Permeability Test

This test enables the longitudinal air permeability of the tested cords to be determined by measuring the volume of air passing through a specimen under constant pressure over a given time. The principle of such a test, well known to those skilled in the art, is to demonstrate the effectiveness of the treatment of a cord in order to make it impermeable to air. The test is described, for example, in standard ASTM D2692-98.

The test is carried out here either on cords extracted from tires or from the rubber plies that they reinforce, which have therefore already been coated from the outside with cured rubber, or on as-manufactured cords which have undergone subsequent coating and curing operations.

In the latter instance, the as-manufactured cords have first of all to be covered, coated from the outside by a rubber known as a coating rubber. To do this, a series of ten cords arranged parallel to one another (with an inter-cord distance of 20 mm) is placed between two skims (two rectangles measuring 80×200 mm) of an uncured rubber composition, each skim having a thickness of 3.5 mm; the whole assembly is then clamped in a mould, each of the cords being kept under sufficient tension (for example 2 daN) to ensure that it remains straight while being placed in the mould, using clamping modules; the vulcanizing (curing) process then takes place over 40 minutes at a temperature of 140° C. and under a pressure of 15 bar (applied by a rectangular piston measuring 80×200 mm). After that, the assembly is demoulded and cut up into 10 specimens of cords thus coated, in the form of parallelepipeds measuring 7×7×20 mm, for characterization.

A conventional tyre rubber composition is used as coating rubber, the said composition being based on natural (peptized) rubber and N330 carbon black (60 phr), also containing the following usual additives: sulphur (7 phr), sulfenamide accelerator (1 phr), ZnO (8 phr), stearic acid (0.7 phr), antioxidant (1.5 phr) and cobalt naphthenate (1.5 phr); the modulus E10 of the coating rubber is about 10 MPa.

The test is carried out on 2 cm lengths of cord, hence coated with its surrounding rubber composition (or coating rubber) in the cured state, as follows: air under a pressure of 1 bar is injected into the inlet of the cord and the volume of air leaving it is measured using a flow meter (calibrated for example from 0 to 500 $cm^3$/min). During measurement, the cord specimen is immobilized in a compressed airtight seal (for example a dense foam or rubber seal) so that only the quantity of air passing through the cord from one end to the other along its longitudinal axis is measured; the airtightness of the airtight seal is checked beforehand using a solid rubber specimen, that is to say one containing no cord.

The higher the longitudinal impermeability of the cord, the lower the measured flow rate. Since the measurement is accurate to ±0.2 $cm^3$/min, measured values equal to or lower than 0.2 $cm^3$/min are considered to be zero; they correspond to a cord that can be termed completely airtight along its axis (i.e. in its longitudinal direction).

II-1-C. Filling Rubber Content

The amount of filling rubber is measured by measuring the difference between the weight of the initial cord (therefore the in-situ rubberized cord) and the weight of the cord (and therefore that of its wires) from which the filling rubber has been removed using an appropriate electrolytic treatment.

A cord specimen (1 m in length), coiled on itself to reduce its size, constitutes the cathode of an electrolyser (connected to the negative terminal of a generator) while the anode (connected to the positive terminal) consists of a platinum wire.

The electrolyte consists of an aqueous (demineralised water) solution containing 1 mol per liter of sodium carbonate.

The specimen, completely immersed in the electrolyte, has voltage applied to it for 15 minutes with a current of 300 mA. The cord is then removed from the bath and abundantly rinsed with water. This treatment enables the rubber to be easily detached from the cord (if this is not so, the electrolysis is continued for a few minutes). The rubber is carefully removed, for example by simply wiping it using an absorbent cloth, while untwisting the wires one by one from the cord. The wires are once again rinsed with water and then immersed in a beaker containing a mixture of demineralised water (50%) and ethanol (50%); the beaker is immersed in an ultrasonic bath for 10 minutes. The wires thus stripped of all traces of rubber are removed from the beaker, dried in a stream of nitrogen or air, and finally weighed.

From this is deduced, by calculation, the filling rubber content of the cord, expressed in mg of filling rubber per gram of initial cord averaged over 10 measurements (10 meters of cord in total).

II-2. Cord Manufacture and Tests

In the following tests, layered cords of 1+6+12 construction, made up of fine brass-coated carbon-steel wires, were used.

The carbon steel wires were prepared in a known manner, for example from machine wire (diameter 5 to 6 mm) which was firstly work-hardened, by rolling and/or drawing, down to an intermediate diameter of around 1 mm. The steel used was a known carbon steel (US standard AISI 1069) with a carbon content of 0.70%. The wires of intermediate diameter underwent a degreasing and/or pickling treatment before their subsequent conversion. After a brass coating had been applied to these intermediate wires, what is called a "final" work-hardening operation was carried out on each wire (i.e. after the final patenting heat treatment) by cold-drawing in a wet medium with a drawing lubricant for example in the form of an aqueous emulsion or dispersion. The brass coating surrounding the wires had a very small thickness, markedly lower than 1 micron, for example of the order of 0.15 to 0.30 μm, which is negligible by comparison with the diameter of the steel wires. The steel wires thus drawn had the diameters and mechanical properties indicted in Table 1 below.

TABLE 1

| Steel | ϕ (mm) | Fm (N) | Rm (MPa) |
|---|---|---|---|
| NT | 0.18 | 68 | 2820 |
| NT | 0.20 | 82 | 2620 |

These wires were then assembled in the form of 1+6+12 layered cords the construction of which is as shown in FIG. 1 and the mechanical properties of which are given in Table 2.

TABLE 2

| Cord | $p_2$ (mm) | $p_3$ (mm) | Fm (daN) | Rm (MPa) | At (%) |
|---|---|---|---|---|---|
| C-1 | 10 | 10 | 126 | 2645 | 2.4 |

The 1+6+12 cord example (C-1) prepared according to the method of the invention, as depicted schematically in FIG. 1, is therefore made up of 19 wires in total, a core wire of diameter 0.20 mm and 18 wires around it, all of diameter 0.18 mm, which have been wound in two concentric layers at the same pitch ($p_2$=$p_3$=10.0 mm) and in the same direction of twist (S) to obtain a cord of the compact type. The filling rubber content, measured using the method indicated above at paragraph II-1-C, was about 22 mg per g of cord. This filling rubber was present in each of the 24 capillaries formed by the various wires considered in threes, i.e. it completely or at least partly filled each of these capillaries such that, over any 2 cm length of cord, there was at least one plug of rubber in each capillary.

To manufacture this cord, use was made of a device as described hereinabove and schematically depicted in FIG. 1. The filling rubber was a conventional rubber composition for the carcass reinforcement of a tyre for industrial vehicles, having the same formulation as the rubber carcass ply that the cord C-1 was intended to reinforce; this composition was based on natural (peptized) rubber and on N330 carbon black (55 phr); it also contained the following usual additives: sulphur (6 phr), sulfenamide accelerator (1 phr), ZnO (9 phr), stearic acid (0.7 phr), antioxidant (1.5 phr), cobalt naphthenate (1 phr); the E10 modulus of the composition was around 6 MPa. This composition was extruded at a temperature of around 85° C. through two sizing dies (11*a*, 11*b*) having respective diameters of 0.250 and 0.580 mm.

The cords C-1 thus prepared were subjected to the air permeability test described at paragraph II-1-B, measuring the volume of air (in $cm^3$) passing through the cords in 1 minute (averaged over 10 measurements for each cord tested). For each cord C-1 tested and for 100% of the measurements (i.e. ten specimens out of ten), a flow rate of zero or of less than 0.2 $cm^3$/min was measured; in other words, the cords prepared in accordance with the method of the invention can be termed airtight along their longitudinal axis; they therefore have an optimum level of penetration by the rubber.

Furthermore, control cords rubberized in situ and of the same construction as the above compact cords C-1 were prepared in accordance with the method described in the aforementioned application WO 2005/071557, in several discontinuous steps, sheathing the intermediate 1+6 core strand using an extrusion head, then in a second stage cabling the remaining 12 wires around the core thus sheathed, to form the outer layer. These control cords were then subjected to the air permeability test of paragraph I-2.

It was noted first of all that none of these control cords gave 100% (i.e. ten specimens out of ten) measured flow rates of zero or less than 0.2 $cm^3$/min, or in other words that none of these control cords could be termed airtight (completely airtight) along its axis. It was also found that, of these control cords, those which exhibited the best impermeability results (i.e. an average flow rate of around 2 $cm^3$/min) all had a relatively large amount of unwanted filling rubber overspilling from their periphery, making them ill suited to a satisfactory calendering operation under industrial conditions.

To sum up, the above-described method allows the manufacture of cords of M+N+P construction, rubberized in situ and which, thanks to an optimum level of penetration by rubber, on the one hand exhibit high endurance in tyre carcass reinforcements and on the other hand can be used efficiently under industrial conditions, notably without the difficulties associated with an excessive overspill of rubber during their manufacture.

The invention claimed is:

1. A method of manufacturing a metal cord with three concentric layers rubberized in situ, i.e. incorporating a composition made of rubber in an uncrosslinked state referred to as "filling rubber", the cord comprising a first, internal, layer or core (C1), consisting of M wires of diameter $d_1$, M varying from 1 to 4, wherein the diameter $d_1$ is in a range from 0.08 to 0.50 mm around which there are wound together in a helix, at a pitch $p_2$, in a second, intermediate, layer (C2), N wires of diameter $d_2$, N varying from 3 to 12, around which second layer there are wound together as a helix at a pitch $p_3$, in a third, outer, layer (C3), P wires of diameter $d_3$, P varying from 8 to 20, the method comprising:

sheathing the core (C1) with a first filling rubber;

twisting the N wires of the second layer (C2) around the sheathed core (C1) to form, at a point named an "assembling point", an intermediate cord named "core strand" (C1+C2);

sheathing the core strand (C1+C2) with a second filling rubber downstream of the assembling point;

twisting the P wires of the third layer (C3) around the sheathed core strand (C1+C2); and twist-balancing to uniformly distribute said first and second filling rubber in the uncrosslinked state into capillaries formed by the N wires of the second layer (C2) and the P wires of the third layer (C3).

2. The method according to claim 1, wherein an extrusion temperature for the filling rubber in each said sheathing step is between 50° C. and 120° C.

3. The method according to claim 1, wherein a total quantity of filling rubber delivered in the two sheathing steps is between 5 and 40 mg per gram of final cord.

4. The method according to claim 1, wherein the core and the core strand, after sheathing, are each covered with a minimum thickness of filling rubber that exceeds 5 μm.

5. The method according to claim 1, wherein the filling rubber is a diene elastomer.

6. The method according to claim 5, wherein the diene elastomer is chosen from the group consisting of polybutadienes, natural rubber, synthetic polyisoprenes, butadiene copolymers, isoprene copolymers, and blends of these elastomers.

7. The method according to claim 6, wherein the diene elastomer is an isoprene elastomer.

8. The method according to claim 1, wherein a tensile stress applied to the core strand, downstream of the assembling point, is between 10 and 25% of its breaking strength.

9. The method according to claim 1, wherein M is equal to 1.

10. The method according to claim 1, wherein the diameter $d_2$ is in a range from 0.08 to 0.45 mm and the pitch $p_2$ is in a range from 5 to 30 mm.

11. The method according to claim 1, wherein the diameter $d_3$ is in a range from 0.08 to 0.45 mm and the pitch $p_3$ is greater than or equal to $p_2$.

12. The method according to claim 1, wherein the wires of the third layer (C3) are wound in a helix at a same pitch and in a same direction of twisting as the wires of the second layer (C2).

13. The method according to claim 1, wherein N varies from 5 to 7.

14. The method according to claim 1, wherein P varies from 10 to 14.

15. The method according to claim 1, wherein the third layer (C3) is a saturated layer.

16. An in-line rubberizing and assembling device of a cord, said device comprising, from upstream to downstream in the direction of travel of the cord as it is being formed:

a feed device configured to feed a first layer or a core (C1);

a first sheathing device configured to sheath the core (C1) with a first filling rubber;

a feed device configured to feed the N wires of the second layer (C2);

a first assembling device configured to twist assemble the N wires around a sheathed core (C1) at a point named the assembling point, to form an intermediate cord named "core strand" (C1+C2);

a second sheathing device arranged downstream of the assembling point and configured to sheath the core strand (C1+C2) with a second filling rubber;

a feed device arranged at an exit from the second sheathing device and configured to feed the P wires of a third layer (C3);

a second assembling device configured to twist assemble P wires around the core strand (C1+C2) to apply the third layer (C3); and a twist balancing device arranged at an exit from the second assembling device and configured to uniformly distribute said first and second filling rubber in the uncrosslinked state into capillaries formed by the N wires of the second layer (C2) and the P wires of the third layer (C3).

17. The device according to claim 16, comprising a stationary feed and a rotating receiver.

18. The device according to claim 16, wherein the first and second sheathing devices each have a single extrusion head comprising at least one sizing die.

19. The device according to claim 16, wherein the twist balancing device comprises at least one tool chosen from straighteners, twisters, or twister-straighteners.

* * * * *